US005695055A

United States Patent [19]

Kormanik, Jr.

[11] Patent Number: 5,695,055

[45] Date of Patent: Dec. 9, 1997

[54] PROTECTIVE SLEEVE FOR GOLF BAGS

[76] Inventor: Charles Kormanik, Jr., 60 Atteridge, Lake Forest, Ill. 60045

[21] Appl. No.: 339,602

[22] Filed: Nov. 15, 1994

[51] Int. Cl.[6] ..... B65D 85/00

[52] U.S. Cl. ..... 206/315.9; 206/315.4; 383/88

[58] Field of Search ..... 206/315.4, 315.9; 150/159; 383/33, 89, 88, 90, 91

[56] References Cited

U.S. PATENT DOCUMENTS

| | | | |
|---|---|---|---|
| 917,124 | 4/1909 | Peirson | 383/89 |
| 2,922,568 | 1/1960 | Harker | 383/88 |
| 3,709,553 | 1/1973 | Churchill et al. | 296/28 |
| 3,754,587 | 8/1973 | Raimieri | 150/52 |
| 4,057,949 | 11/1977 | Greffe | 383/88 |
| 4,200,133 | 4/1980 | Whitlow | 150/52 |
| 4,545,579 | 10/1985 | McCain | 273/162 R |
| 4,752,004 | 6/1988 | Very | 206/315.4 |
| 4,795,270 | 1/1989 | Heyden | 383/88 |
| 4,953,768 | 9/1990 | Muse | 224/205 |
| 4,979,548 | 12/1990 | Howard et al. | 150/159 |
| 5,005,624 | 4/1991 | Sung | 150/160 |
| 5,058,642 | 10/1991 | Tuntland | 150/159 |
| 5,131,442 | 7/1992 | Bevier | 150/159 |
| 5,220,950 | 6/1993 | Cordasco | 150/159 |
| 5,274,901 | 1/1994 | Sanders | 150/159 |

FOREIGN PATENT DOCUMENTS

| | | | |
|---|---|---|---|
| 222184 | 5/1987 | European Pat. Off. | 383/33 |
| 834640 | 3/1952 | Germany | 383/88 |

*Primary Examiner*—David T. Fidei
*Attorney, Agent, or Firm*—Peter K. Trzyna

[57] ABSTRACT

A protective sleeve comprising a combination of a mouth and a sleeve, the combination comprising a sleeve having a first and second flaps extending beyond the sleeve, each flap having a proximate side and a distal side, with the sleeve having an opening between the flaps and having a protective mouth. The mouth includes a lip formed by folding the first flap along a line and away from the opening until the first flap is adjacent to the sleeve; a second lip formed by folding the second flap over the opening until the second flap is adjacent to the first lip; and including joints adjacent to the proximate and distal sides of the second flap, the joints being located to urge the flaps in an orientation planar with the sleeve.

17 Claims, 2 Drawing Sheets

PROTECTIVE SLEEVE FOR GOLF BAGS

1. Field of the Invention

The present invention pertains to a mouth in combination with a protective covering for receptacles and other objects. More particularly, the protective covering can be a plastic sleeve or bag, a version of which is suitable for keeping precipitation from wetting golf clubs and other implements of the game that are stored in a golf bag. Packaging for this and other such rain gear is also provided.

2.Background of the Invention

Various kinds of protective covers for receptacles, particularly those involving golf bags, have been proposed. Representative examples are shown in U.S. Pat. Nos. 3,709,553 (Golf Car Rain Coat); 3,754,587 (Golf Club Cover); 4,752,004 (Protective Cover For Golf Bag); 4,953,768 (Golf Bag Rain Cover); 4,200,133 (Golf Bag Cover); 4,979,548 (Golf Bag Cover); 5,005,624 (Device For Protecting Golf Clubs); 5,058,642 (Golf Bag Cover); 5,131,442 (Golf Bag Cover For Protecting Clubs); and 5,220,950 (Golf Bag Cover). Protective covers can also include sandwich bags, seat cushion covers, rain gear, shirt packages, and the like.

The variety of designs for protective covers or receptacles reflects the variety of uses. Some protective covers that are closed by means of a mouth having a flap (e.g., that in U.S. Pat. No. 3,754,587). However, this type of mouth tends to open or provide a poor seal when the receptacle is flexed, unless a seam or other closing approach is used. Further, the known prior art receptacles that have specific uses, such as that for protecting golf bags from inclement weather, have devoted little attention to packaging for the receptacles.

SUMMARY OF THE INVENTION

It has been discovered that a receptacle made with two flaps provides a better closure for the mouth of the receptacle than that generally obtained from one flap, and thus protective coverings and packaging therefore can make use of this improvement.

For example, a protective sleeve can be made from a tube or by means such as two rectangular plastic sheets placed in parallel orientation and seamed along opposing edges to form sides. When desirable for a particular use, the protective sleeve can have a bottom formed by a seam joining another edge of each sheet. Between the sides of this sleeve, there is a top. A portion of the top can be folded over a line perpendicular to the sides to form a flap comprised of lips from both the sheets. The flap has two ends, a proximate and a distal end, and a joint located adjacent to each of the ends and one of the sheets disposes the flap and the sheets in a parallel orientation. Preferably, a tab-like seal spaced inward from each of the ends aids in disposing the flap and sheets.

In an embodiment of the present invention, a second fold is located in the top portion of the sleeve. The fold can be in the same direction as the first fold, or the second fold can be in the opposite direction. In either case, the second fold can be in the midst of the flap, or alternatively, the second fold can be located in the sleeve so that the flap is unbroken by the second fold.

In using the mouth with a flap having two lips, after the mouth has opened to locate an item in or out of the sleeve by pulling the lips apart, the ends or the tabs of the flap can be pulled outward to close the sleeve. The mouth with a flap having two lips is better disposed to closure such that during flexing of the sleeve, both lips comprised in the flap tend to flex harmoniously, providing a better protection against undesired opening of the mouth than might occur from a flap made from a single lip. Tabs 31 and 33, useful for improving the ease of handling during closing of the flaps, may be formed at each of the proximate and distal ends 24 and 26 of the flap 20 by creating a respective seam or area spaced from each of the ends 24 and 26 and running approximately the length of the flap 20. The seams, which preferably fasten all sheets of the flap, may be welded, heat sealed, or otherwise joined.

Further, addition of the tabs allows easy location of the proximal and distal ends of the flap and ensure proper orientation of the sheets of the flap to allow the flap to snap shut when the tabs are pulled in opposite directions.

Additionally, a protective sleeve such as that employing the protective cover can be packaged thematically. For example, if the sleeve is used for a golf bag, this sleeve can be housed in a plastic assembly resembling a golf ball, which in turn can be located in a box resembling that which is used to house golf balls, thereby suggesting the use to which the sleeve can be applied. Alternately, the sleeve could be used to hold materials as with a "ditty" bag.

Finally, the present invention with thematic packing can be utilized in a variety of contexts, for example, where such rain gear is useful, with the packaging resembling the balls or other accoutrements of each context, along with a box therefore. Potential applications can include plastic ball housings and respective boxes for gear suitable for baseball, football, and tennis games, other outdoor events such as concerts or shows, or other activities.

DETAILED DESCRIPTION OF THE DRAWINGS

Figure 1:
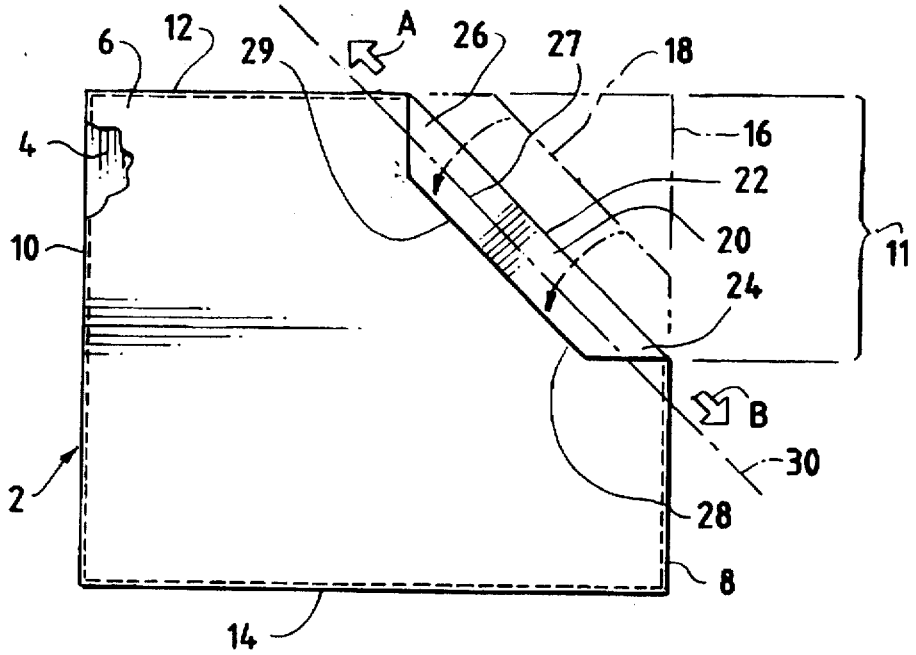
FIG. 1 is a drawing of a first embodiment of a protective sleeve comprising a mouth in combination with a sleeve according to the present invention.
Figure 2:
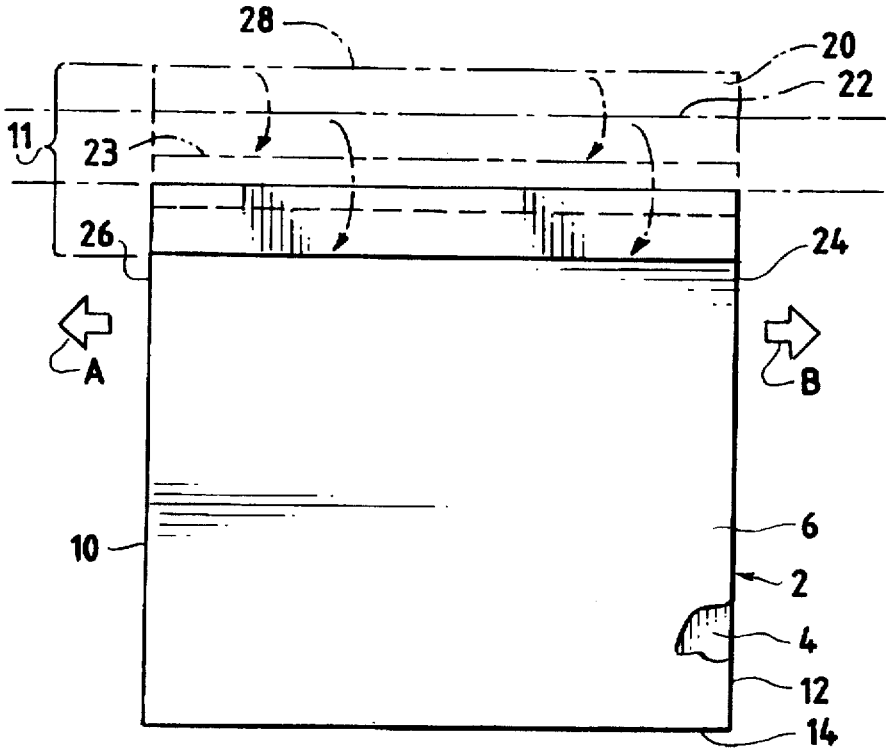
FIG. 2 is a drawing of a second embodiment of a protective sleeve comprising a mouth in combination with a sleeve of the present invention.

FIG. 1 illustrates one embodiment of a protective sleeve 2 in accordance with the present invention. Protective sleeve 2 can be made from two adjacent sheets 4 and 6 of plastic. The sheets can be joined by seems 8 and 10 to define respective sides of the sleeve. In contradistinction to FIG. 2, FIG. 1 shows a mouth 11 located at a corner of the sleeve, such that seam 12 extends from seam 10 a portion of the way toward seam 8. The seams can be welded, heat sealed, or otherwise joined. Instead of a seam, some other means for joining the sheets would work just as well, as could a seamless sleeve or tube formed by extrusion, for example. A bottom 14 of the protective sleeve 2 can be defined by locating a seam 14 along edges of the sheets 4 and 6 between seams 8 and 10.

In this first embodiment, if the sleeve is being formed from the two adjacent sheets 4 and 6, a corner 16 (denoted in FIG. 1 with dashed lines) of each of the sheets 4 and 6 can be removed. Preferably, to form the mouth 11 both the corners are removed up to an edge line 18, though the sheets 4 and 6 need not have equal areas removed. A flap 20 comprised of a portion of each of the two sheets 4 and 6, is relocated by rotation along fold line 22. Flap 20 is then joined to the sheet 4 and/or 6 at a proximate end 24 of the flap and a distal end 26 of the flap. Accordingly, flap 20 has two lips, lip 27 and lip 29, emanating from sheets 6 and 4, respectively. There also is an opening 28 to the protective sleeve 2 through the mouth 11. Tabs 31 and 36, shown as a triangular area in FIG. 1 and as a line or edge in FIG. 2.

In using a protective sleeve 2 made as described above, mouth 11 and opening 28 can be used to insert or remove an implement from the protective sleeve 2. This can be accomplished by moving the lips 27 and 29 apart to expand the area of the opening 28. Then, by pulling opposing ends or tabs 24 and 26 outwardly (as illustrated by arrows A and B in FIG. 1), the opening 28 is drawn closed. To further induce the closing, the protective sleeve 2 can have a crease set along fold line 22 by heat or mechanical means. To induce closing over more, a second fold can be located along a line 30 in flap 20 (or in the protective sleeve 2, as shown in FIG. 2). The second fold can be in either direction rotating along line 30, with joints located adjacent ends 24 and 26 to bias sheets 4 and 6 into the second fold.

FIG. 2 illustrates another embodiment of the protective sleeve 2 of the present invention. Again there are the two adjacent sheets 4 and 6, oriented and combined generally as set forth above, except that the opening is not formed from a corner. Also, for better closure, a double fold is illustrated.

More particularly, flap 20 is formed by folding sheets 4 and 6 along line 22, either direction, as shown in FIG. 2. Optionally, a second fold in either direction along line 23 locates the second fold in the protective sleeve 2 while leaving flap 20 unbroken, as illustrated in FIG. 2. That is, flap 20 is drawn over or under flap line 23 and adjacent to sheet 4 or sheet 6; the proximate and distal sides 24 and 26 are suitable locations for joining the flap 20 to the respective sheet 4 or 6.

The use of the second embodiment of protective sleeve 2 is much the same as that described above. After inserting or removing an implement from the protective sleeve 2 via mouth 11 and opening 28, the opposing ends 24 and 26 are pulled apart in directions denoted by arrows A and B to close the protective sleeve 2. Similarly, tabs 31 and 33 can instead be pulled apart.

Figure 3:
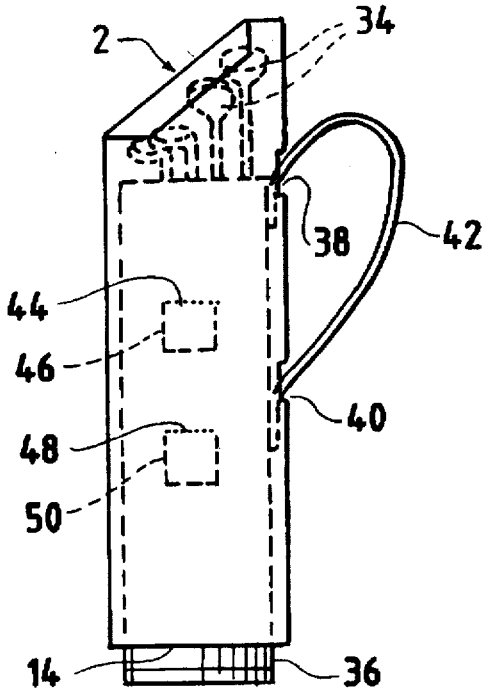
FIG. 3 is a drawing of the protective sleeve of the present invention being used to cover a golf clubs within a golf bag.
Figure 4:
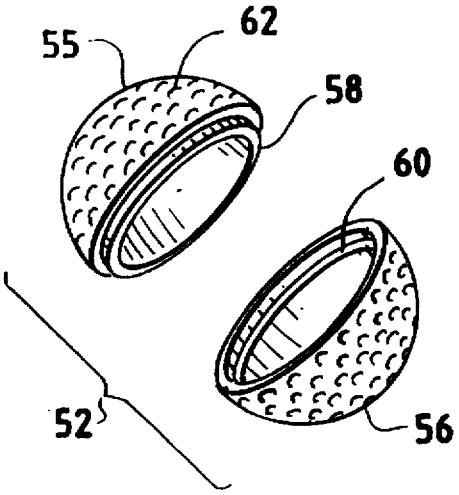
FIG. 4 is a drawing of golf ball-like packaging for the protective sleeve of the present invention.
Figure 5:
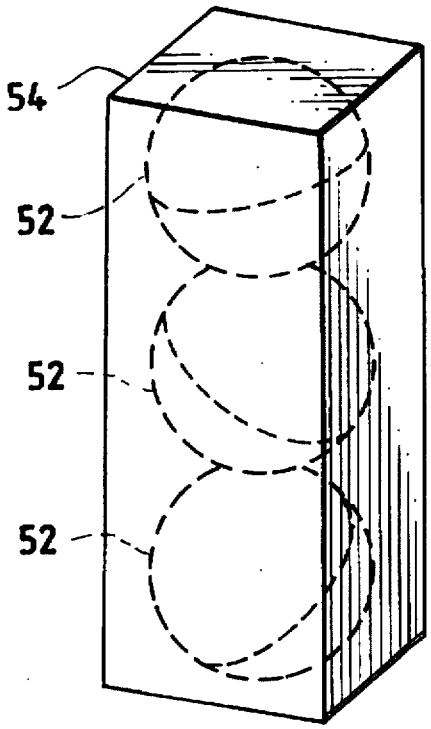
FIG. 5 is a drawing of a box containing the golf ball-like packaging for the protective sleeve of the present invention.

FIG. 3 illustrates one of the many applications for this invention; the application is as a protective sleeve for golf clubs 34 in a golf bag 36. The protective sleeve 2 is made of a length sufficient to extend over the golf clubs 34 and preferably over a portion of the golf bag 36. The opening 28 is of sufficient size and at a suitable location so as to permit removal and replacement of the golf clubs 34 in the golf bag 36. The flap 20 limits precipitation from entering the opening 28.

Preferably for this application, the protective sleeve has two additional openings 38 and 40 along its vertical axis. The additional openings 38 and 40 are of sufficient size and spaced sufficiently apart to allow a carrying handle 42 to be connected to the golf bag 36 through the additional openings 38 and 40. Bottom 14 can be left unseamed to permit the golf bag 36 to sit directly on ground.

Note that for protection against inclement weather and other conditions where moisture is a factor, the protective sleeve 2 should be made of a water resistant or water proof material, such as plastic, rubber, or the like. Cloth could function as a water resistant material, but its weight for most applications is excessive.

As a further feature for applying the present invention to protect golf clubs 34 in a golf bag 36 from inclement weather, there can be one area 44 of perforations in the protective sleeve 2. The perforations are located along a portion of a circumference of the protective sleeve 2, the perforations 44 being sufficient in number and located to permit tearing the protective sleeve 2 along the perforations for accessing a pocket 46 in the golf bag 36.

Similarly, a second area of perforations 48 in the protective sleeve 2 can be located along a portion of another circumference of the second area of the sleeve 2, the second area of the perforations 44 being sufficient in number and located to permit tearing the protective sleeve 2 along the second area of the perforations 48 for accessing a second pocket 50 in the golf bag 36.

In such an application, the protective sleeve 2 can be located in thematic packaging. For example, an embodiment of the present invention can be located in the thematic packaging 52 that resembles a golf ball. Although the packaging 52 could be made by stuffing the protective sleeve 2 into a balloon, latex sleeve, or the like, having printing that depicts the exterior of a golf ball, a more realistic looking version can be made from two generally hemispheric halves 54 and 56, joinable by such means as an interior lip 58 that engages an exterior lip 60 when the halves are pushed together to encase the protective sleeve 2. For an even more realistic appearance, the packaging 52 can have marks 62, identical to the dimples on a golf ball.

To continue the theme, three of the packaging 52 items can be located in a box 54 resembling that which is used to contain and sell golf balls—or more precisely, what is known as a "sleeve" of golf balls. In a similar vein, the items in the box 54 can include a variety of articles made of the protective sleeve 2, including a rain coat or vest, a hat, a wiping cloth, or a seat cover for a golf cart seat. This permits a set of golf-related protective coverings for inclement weather to be packaged in a manner suggestive of their use.

The box 54 can be stored in one of the two golf bag pockets 46 and 50, as can a similar looking box containing real golf balls.

Similarly thematic packaging can be utilized to market items consisting of the protective sleeve 2 in a variety of areas. These include gear housed in packaging shaped like baseballs, footballs, tennis balls, etc. for use at such sporting events and these can be placed in boxes 54 suggestive of real balls used for these sports.

Accordingly, the various embodiments of the present invention, as well as their applications and packaging, are considered illustrative and part of the teaching of the invention and how to make and use it. The scope of the invention is intended to be defined by the claims set forth below.

I claim:

1. A combination comprising:

a sleeve having a first flap extending beyond said sleeve and also having a second flap extending beyond said sleeve, each said flap having a proximate side and a distal side, said sleeve having an opening between said flaps and having a mouth including:

a first lip formed by folding said first flap along a line and away from said opening until said first flap is adjacent to said sleeve;

a second lip formed by folding said second flap over said opening until said second flap is adjacent to said first lip; and a first joint adjacent to said proximate side of said second flap and a second joint adjacent to said distal side of said second flap, said first joint and said second joint securing said flaps to said sleeve to urge said flaps in a parallel planar orientation for closing said mouth; and wherein:

said mouth is openable by pulling said lips apart in opposite directions perpendicular to the line; and wherein:

said mouth is closable by pulling said proximate and said distal sides in opposite directions parallel to said line.

2. The combination of claim 1, further comprising:

a third lip formed by folding said second flap along a second line parallel to said first line and disposed between a terminus of said second flap and said first line and toward said second lip and away from a main body of said sleeve until said second flap is adjacent said second lip; and a fourth lip formed by folding said first flap over said second flap until said first flap is adjacent to said third lip.

3. The combination of claim 1, further comprising:

a third lip formed by folding said first flap along a second line parallel to said first line and disposed between a terminus of said first flap and said first lip and toward said first lip and toward a main body of said sleeve until said first flap is adjacent said first lip; and a fourth lip formed by folding said second flap over said first flap until said second flap is adjacent to said third lip.

4. The combination of claim 1, further comprising:

a third lip and a fourth lip formed in said first flap, and a fifth lip and sixth lip formed in said second flap, by folding said first and said second flaps in a unison along a second line parallel to said first line and disposed between said first line and a terminus of said first and second lips and toward said opening until the unison of said first and second flaps is adjacent said second flap.

5. The combination of claim 1, further comprising:

a third lip and a fourth lip formed in said first flap, and a fifth lip and a sixth lip formed in said second flap, by folding said first and second flaps in unison along a second line parallel to said first line and disposed between said first line and the terminus of said first and second lips and away from said opening until the unison of said first and second flaps is adjacent said second flap.

6. The combination of any one of claims 1–5, wherein:

said sleeve is of sufficient length to extend over golf clubs in a golf bag and over a portion of said golf bag to protect said golf clubs and said portion of said golf bag from precipitation;

said opening of said combination is of sufficient size and at a location so as to permit removal and replacement of said golf clubs in said golf bag; and said flaps extending over said opening of sufficient size to limit said precipitation from entering said opening.

7. The combination of any one of claims 1–5, wherein:

said combination possess a second opening opposite said first opening, said second opening being of sufficient size to allow said combination to be placed over an object to be protected by means of said second opening.

8. The combination of claim 6, wherein:

said combination is comprised of plastic.

9. The combination of claim 6, wherein:

said combination possesses two additional openings along a vertical axis of said combination, said additional openings of sufficient size and spaced sufficiently apart to allow a carrying handle to be connected to said golf bag through said additional openings.

10. The combination of claim 6, further comprising:

perforations in said combination along a portion of a circumference of said combination, said perforations being sufficient in number and located to permit tearing said combination along said perforations for accessing a sleeve in said golf bag.

11. The combination of claim 6, wherein:

said combination possesses a bottom sealing said sleeve opposite said mouth.

12. The combination of claim 6, wherein:

said combination is removed from a compressed form maintained by a covering of removable packaging material resembling a golf ball to form a packaged combination.

13. The combination of claim 12, wherein:

said compressed form is removed from a container resembling a sleeve of golf balls.

14. The combination of claim 13, wherein:

another compressed form in said container and resembling said ball is from the group consisting of: a wiping cloth, a rain coat, a rain vest, a hat, and a seat cover.

15. The combination of any one of claims 1–5, wherein:

said combination is removed in a compressed form from a ball from a group consisting of a golf ball, a football, a tennis ball, a baseball, a soccer ball, and a rugby ball.

16. The combination of claim 14, wherein said ball is a golf ball, and further comprising:

a container for said ball, the container resembling a sleeve of golf balls.

17. The combination of any one of claims 1–5, further comprising: tabs spaced from each of the sides.

* * * * *